US007798832B2

(12) United States Patent
Qin et al.

(10) Patent No.: US 7,798,832 B2
(45) Date of Patent: Sep. 21, 2010

(54) ELECTRICAL CONNECTOR WITH A PAIR OF IMPROVED DETACTING PINS

(75) Inventors: Fa-Xiang Qin, Kunshan (CN); Zhen-Sheng Wang, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/231,497

(22) Filed: Sep. 2, 2008

(65) Prior Publication Data

US 2009/0061671 A1 Mar. 5, 2009

(30) Foreign Application Priority Data

Sep. 3, 2007 (CN) ..... 2007 2 0046919 U

(51) Int. Cl.
*H01R 29/00* (2006.01)

(52) U.S. Cl. ..... 439/188

(58) Field of Classification Search ..... 439/188, 439/489

See application file for complete search history.

(56) References Cited

U.S. PATENT DOCUMENTS

| | | | | | |
|---|---|---|---|---|---|
| 4,392,708 | A * | 7/1983 | Bailey et al. | ..... | 439/668 |
| 5,055,058 | A * | 10/1991 | Nagasaka et al. | ..... | 439/188 |
| 5,470,251 | A * | 11/1995 | Sano | ..... | 439/489 |
| 5,511,986 | A * | 4/1996 | Casey et al. | ..... | 439/188 |
| 5,613,872 | A * | 3/1997 | Fukuda et al. | ..... | 439/489 |
| 5,674,085 | A | 10/1997 | Davis et al. | | |
| 5,775,936 | A * | 7/1998 | Tsuji | ..... | 439/489 |
| 5,800,192 | A | 9/1998 | David et al. | | |
| 6,027,365 | A * | 2/2000 | Kaufman | ..... | 439/489 |
| 6,095,837 | A * | 8/2000 | David et al. | ..... | 439/188 |
| 6,210,232 | B1 * | 4/2001 | Lai et al. | ..... | 439/620.08 |
| 6,273,757 | B1 * | 8/2001 | David et al. | ..... | 439/607.13 |
| 6,422,895 | B1 * | 7/2002 | Lien | ..... | 439/489 |
| 6,939,168 | B2 * | 9/2005 | Oleynick et al. | ..... | 439/541.5 |
| 7,029,318 | B2 * | 4/2006 | Yu | ..... | 439/488 |
| 7,207,819 | B2 * | 4/2007 | Chen | ..... | 439/188 |
| 7,497,709 | B1 * | 3/2009 | Zhang | ..... | 439/188 |
| 7,575,454 | B1 * | 8/2009 | Aoki et al. | ..... | 439/188 |
| 2004/0033727 | A1 * | 2/2004 | Kao | ..... | 439/660 |
| 2005/0227524 | A1 * | 10/2005 | Zhuang et al. | ..... | 439/188 |
| 2007/0059959 | A1 * | 3/2007 | Chen | ..... | 439/188 |

FOREIGN PATENT DOCUMENTS

| | | |
|---|---|---|
| TW | 497768 | 8/2002 |
| TW | M288046 | 2/2006 |
| TW | M318233 | 9/2007 |

* cited by examiner

*Primary Examiner*—T C Patel
*Assistant Examiner*—Vladimir Imas
(74) *Attorney, Agent, or Firm*—Andrew C. Cheng; Wei Te Chung; Ming Chieh Chang

(57) ABSTRACT

An electrical connector includes an insulating housing defining a base portion and a tongue portion extending forwards from a front face of the base portion, a plurality of terminals and a pair of detecting pins having a moveable pin and an immoveable pin. Each terminal defines a contacting portion located on the bottom face of the tongue portion and a solder leg extending towards a bottom face of the base portion. The two pins respectively define a contacting section spaced from and mating with each other and a leg section spaced from each other. The moveable pin defines an arc section projecting forwards beyond the front face of the tongue portion.

6 Claims, 7 Drawing Sheets

ELECTRICAL CONNECTOR WITH A PAIR OF IMPROVED DETACTING PINS

BACKGROUND OF THE INVENTION

1. Field of the invention

The present invention relates to an electrical connector having a pair of detecting pins.

2. Description of Related Art

U.S. Pat. No. 5,674,085 discloses an electrical connector having a insulating housing defining a tongue portion, a shielding shell surrounding the housing and conductive terminals located on the tongue portion and a detecting pin. The detecting pin is retained in the housing and has a cantilever portion bent and extending below the tongue portion. The cantilever portion will engage with one conductive terminal when a mating connector is inserted into the connector to complete a detecting function.

However, electrical reliability of the terminals will face challenge since one of the terminal functions as a detecting pin synchronously. The cantilever is longer so that it might be permanently distorted.

Therefore, an electrical connector with improved detecting pins is desired to overcome the disadvantages of the related arts.

SUMMARY OF THE INVENTION

An object of the present invention is to provide an electrical connector with a pair of improved detecting pins.

In order to achieve above-mentioned object, an electrical connector includes an insulating housing defining a base portion and a tongue portion extending forwards from a front face of the base portion, a plurality of terminals and a pair of detecting pins having a moveable pin and an immoveable pin. Each terminal defines a contacting portion located on the bottom face of the tongue portion and a solder leg extending towards a bottom face of the base portion. The two pins respectively define a contacting section spaced from and mating with each other and a leg section spaced from each other. The moveable pin defines an arc section projecting forwards beyond the front face of the tongue portion.

Other objects, advantages and novel features of the present invention will become more apparent from the following detailed description of the present embodiment when taken in conjunction with the accompanying drawings.

DETAILED DESCRIPTION OF THE INVENTION

Figure 1:
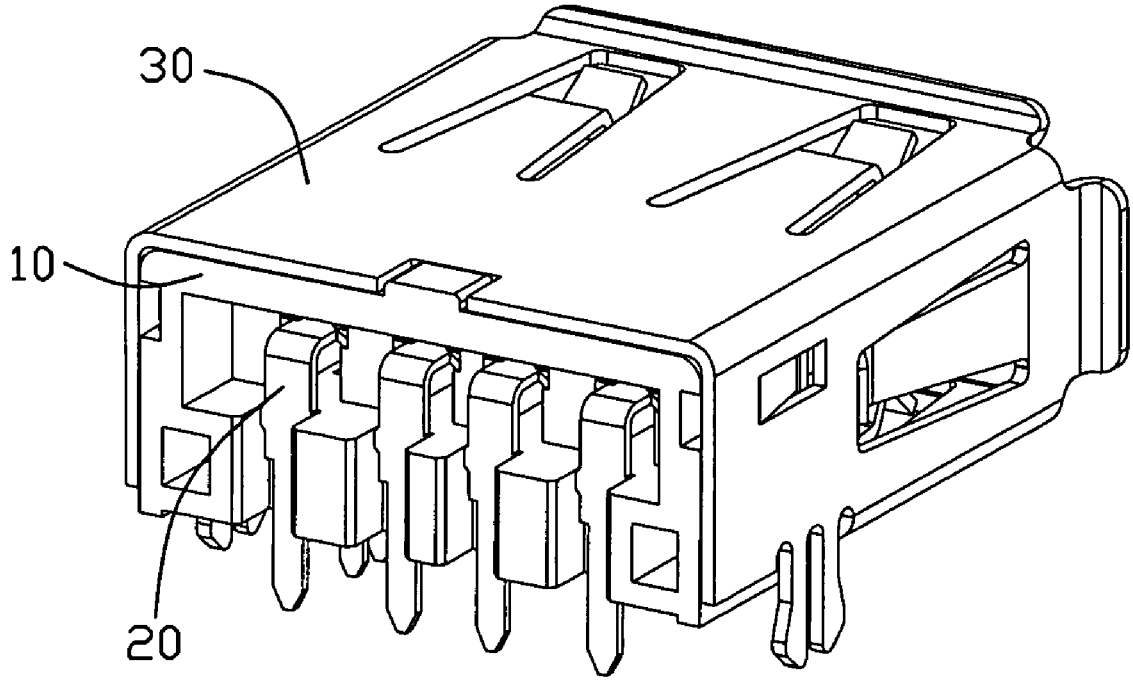
FIG. 1 is a top and rear perspective view of an electrical connector of a first embodiment.

Reference will now be made to the drawing figures to describe a preferred embodiment of the present invention in detail.

Figure 2:
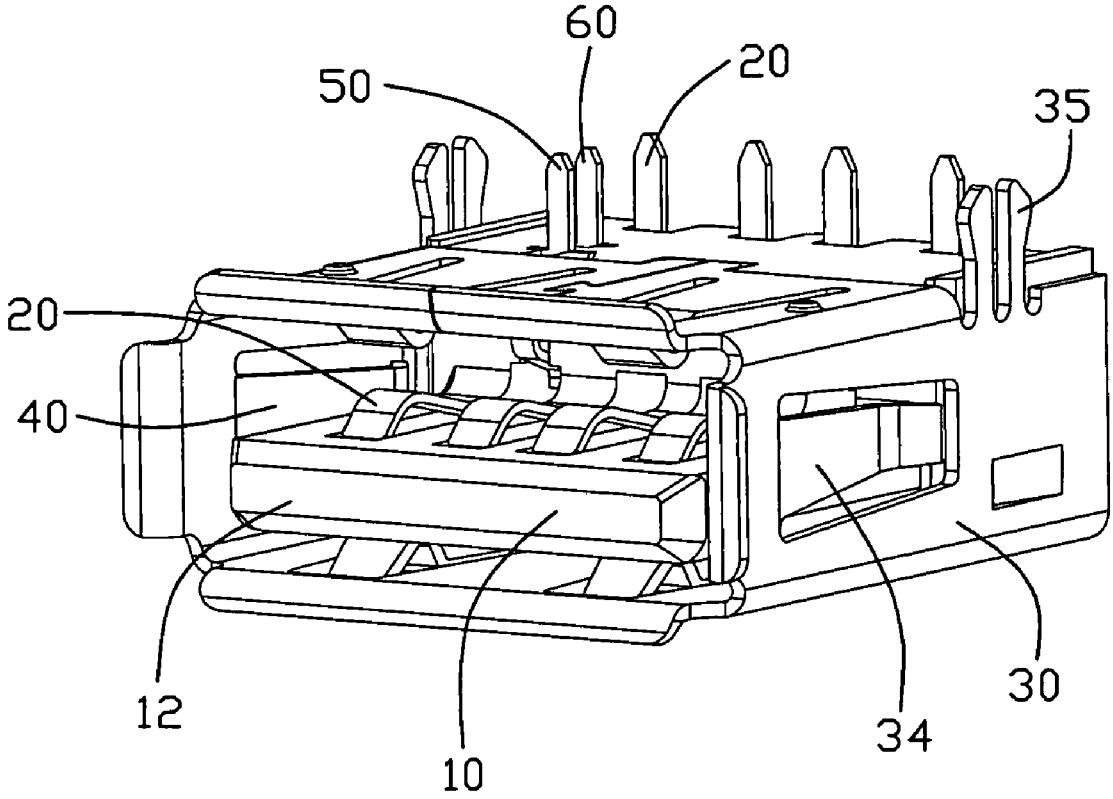
FIG. 2 is a bottom and front perspective view of the electrical connector shown in FIG. 1.

Referring to FIGS. 1 and 2, an electrical connector 1 of a first embodiment of the present invention is used to mate with a counter connector and comprises an insulating housing 10, a plurality of terminals 20 and a shielding shell 30.

Figure 4:
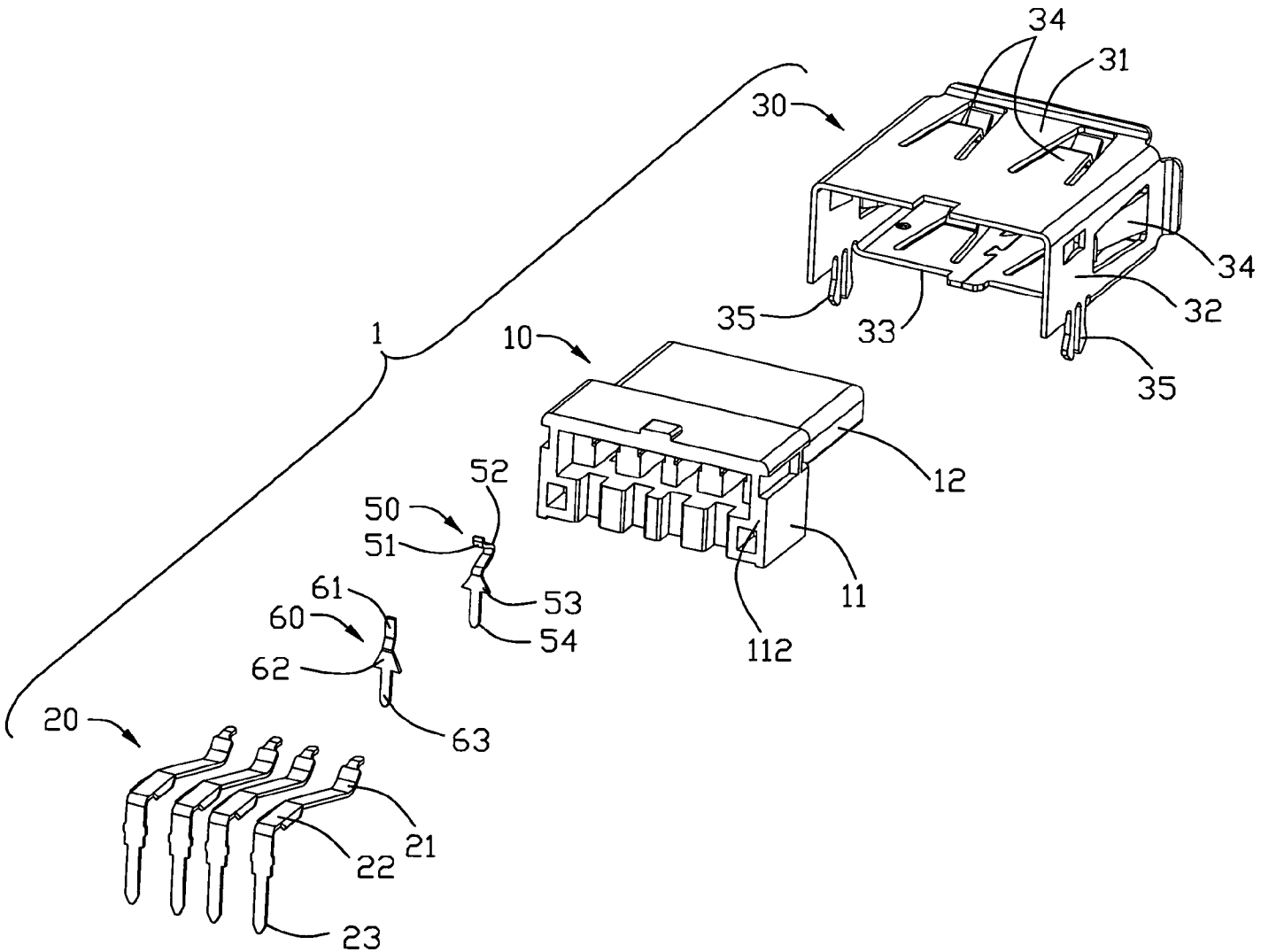
FIG. 4 is an exploded perspective view of the connector shown in FIG. 1.
Figure 5:
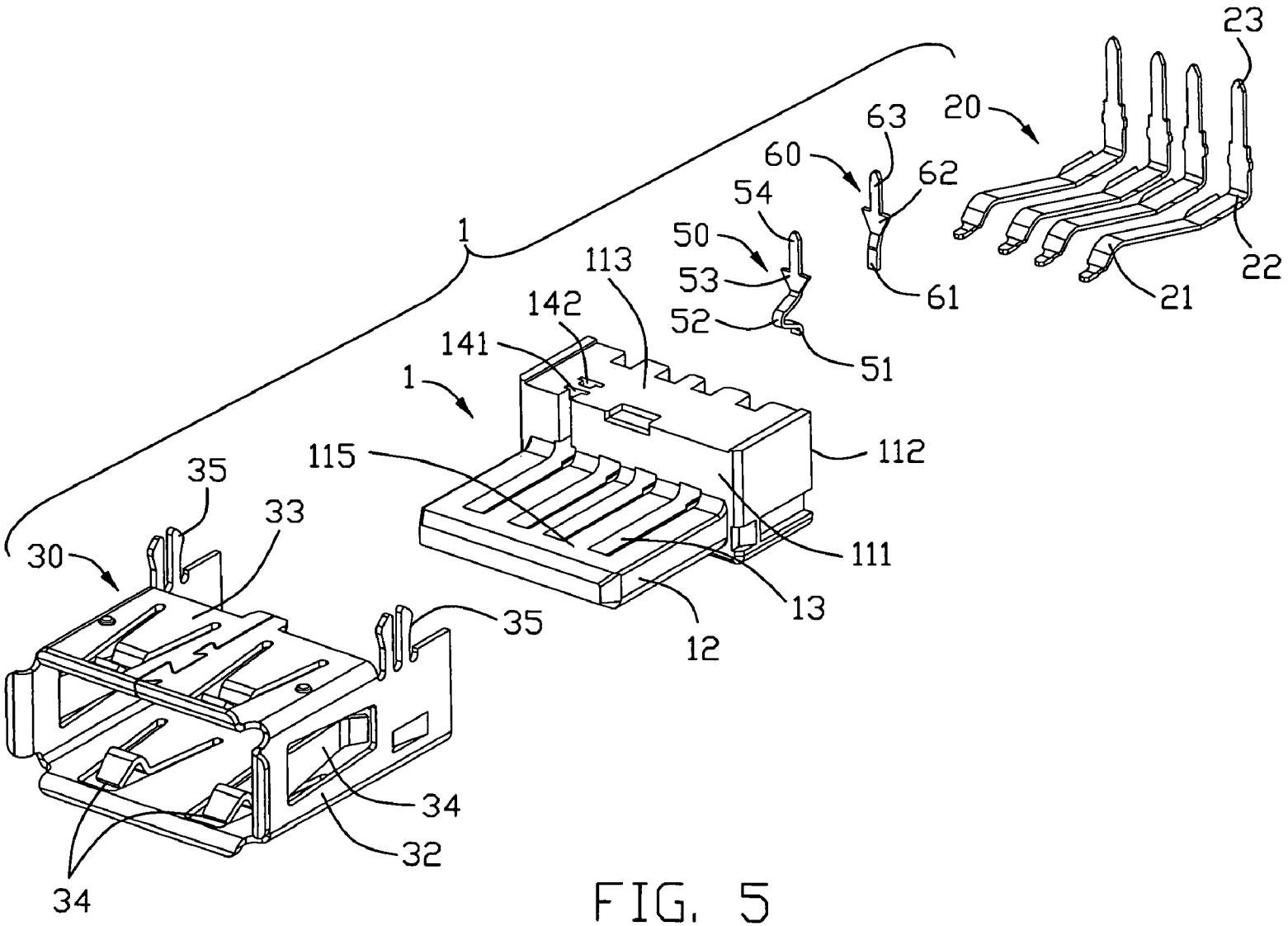
FIG. 5 is an exploded perspective view of the connector shown in FIG. 2.

Referring to FIGS. 4 and 5, the insulating housing 10 made from resin material comprises a base portion 11 and a tongue portion 12 extending forward from a front face 111 of the base portion. The bottom surface 115 of the tongue portion 12 defines four parallel passageways 13 which extend backward through the rear surface 112 of the base portion 11. A bottom surface 113, which functions as a connecting face to the PCB, has two holes 141, 142 arranged along a mating direction of the connector and the two holes communicate with the passageway 13. The front hole 141 communicates with the front face 111 of the base portion. The terminals are received in the passageways 13 and each terminal comprises a retaining section 22, a contacting section 21 extending forward from a front end of the retaining section and located in the tongue portion, and a solder leg 23 bend downward from a rear end of the retaining portion.

Referring to FIGS. 4 and 5, the shell 30 made of metal sheet includes top wall 31, sidewalls 32 bend downward from the top wall and a bottom wall 33 which has a pair of wing portions bend inward from the sidewalls. The top wall, sidewalls and bottom wall respectively define inward spring portions 34. A fork retaining leg 35 extends downward from the bottom of each sidewall 32. The shell surrounds and is retained on the base portion 11 and spaced surrounds the tongue portion to define a mating space 40 as best shown in FIG. 2 to be mated with the counter connector.

Figure 3:
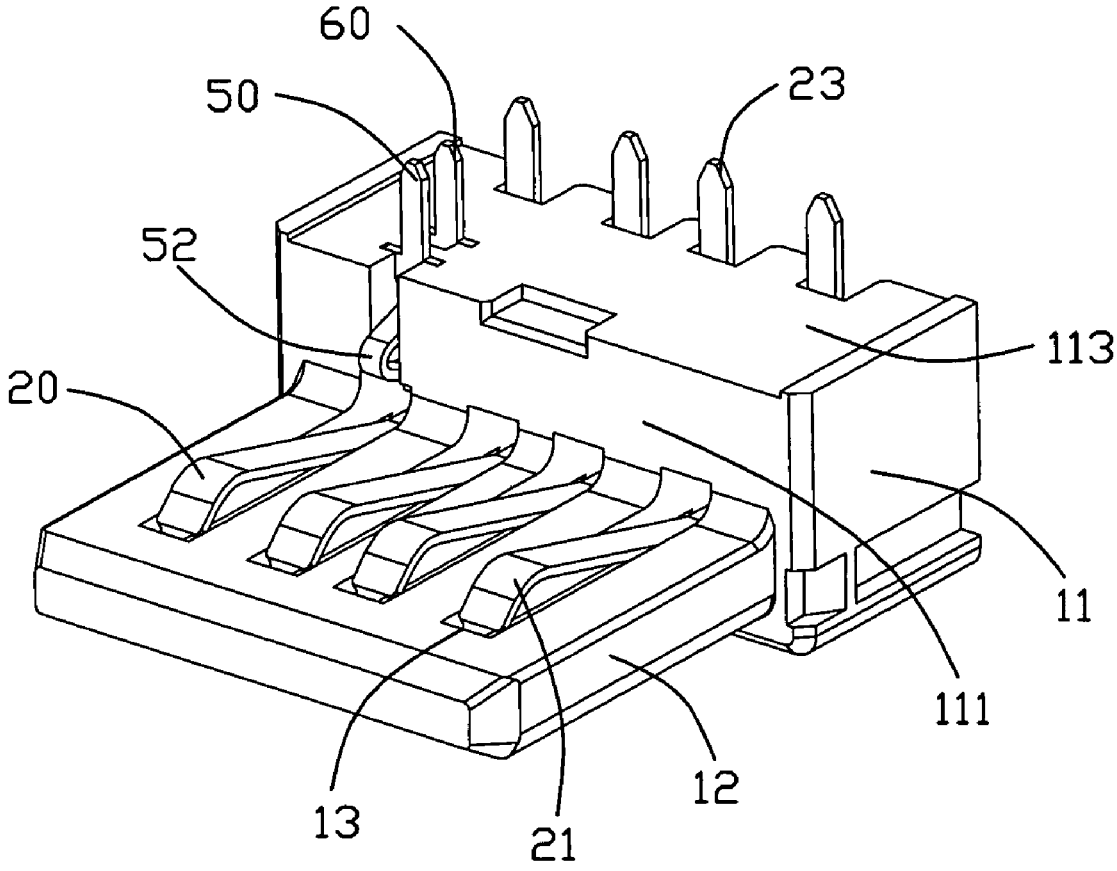
FIG. 3 is a perspective view of part of the electrical connector shown in FIG. 2.

The connector 1 further comprises a pair of detecting pins 50, 60 retained in the holes 141,142 of the housing 1. The first detecting pin 50 is a moveable pin and comprises a retaining section 53, a leg portion 54 extending downward from a bottom end of the retaining section and an arc section 52 bend from top end of the retaining section 53. The second detecting pin 60 is an immoveable pin and comprises a retaining section 62, a leg portion 63 extending downward from a bottom end of the retaining section 62 and a contacting section 61 extending upright from a top end of the retaining section 62. As shown in FIG. 3, the first detecting pin 50 is received in the first hole 141 and the second pin 60 is received in the second hole 142. The arc section 52 of the first detecting pin 50 projects beyond the front face 111 of the base portion. The leg sections of the two pins extend downward beyond the connecting face 113.

Figure 6:
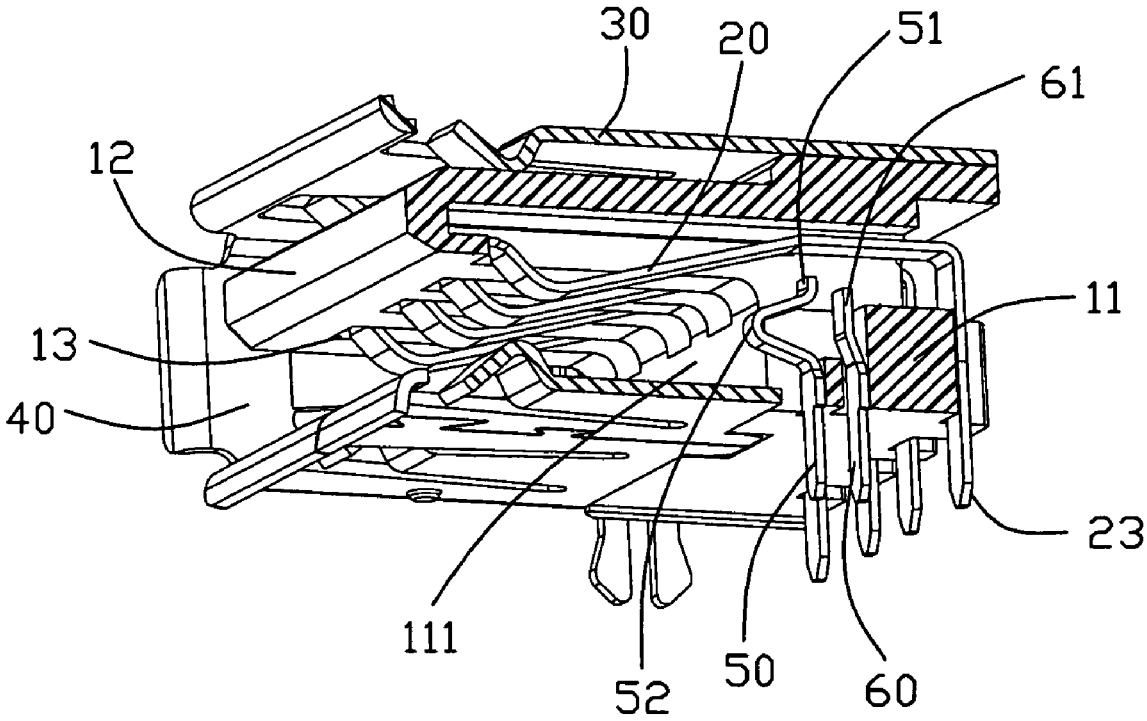
FIG. 6 is a partially cut-out perspective view of the electrical connector.

As shown in FIG. 6, the terminals 20 partly project downward into mating space 40. The first detecting pin 50 is in front of the second pin 60 and the arc section 52 projects into the mating space 40. When the mating space is inserted by the counter connector, the front end of the counter connector will press on the arc section 52 to move the arc section backward, i.e. in the mating direction, and urges the contacting section 51 of the first detecting pin to touch the contact section 61 of the second pin. As a result the two detecting pins complete detecting function.

Figure 7:
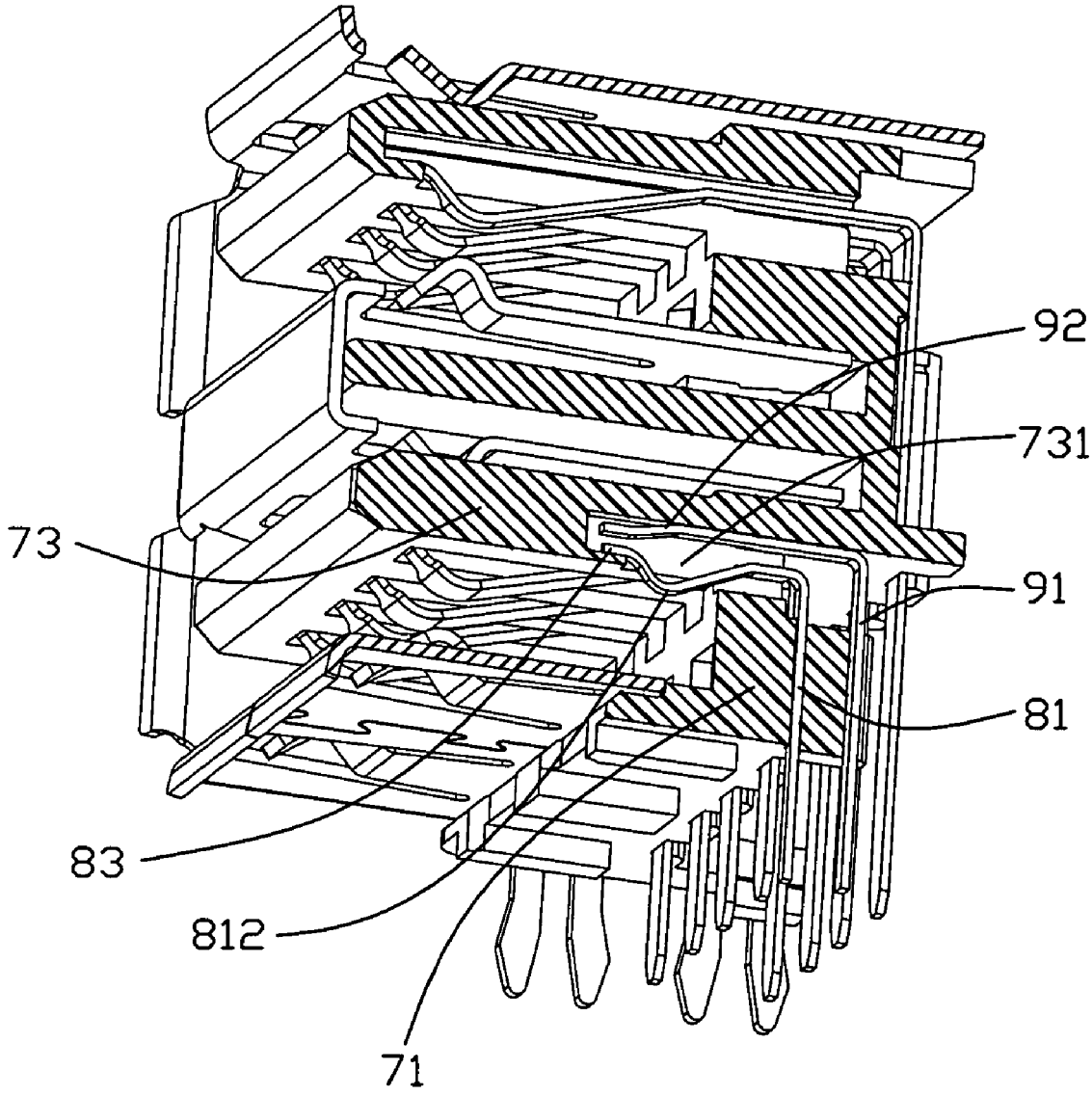
FIG. 7 is a partially cut-out perspective view of an electrical connector of a second embodiment.

An another embodiment is provided in FIG. 7. The electrical connector 7 is a stacked connector which is provided for insertion of two counter connectors. The lower tongue portion 73 has a groove 731 on the bottom face thereof and the groove 731 opens downward and runs though the rear wall of the insulating housing. Two detecting pins are similar to the two pin of said first embodiment. The retaining portion 81, 91 are retained the base portion of the housing 71 in the upper-lower direction. The arc section 82 of the first detecting pin perpendicularly bend forward to receive in the groove 731 and the contacting section of the second detecting pin perpendicularly bend forward to be received in the groove 731. The arc section 82 of the first detecting pin projects downwards in into the mating space, i.e. in a vertical direction perpendicular to the mating direction. The second detecting pin is located above the first detecting pin. When the mating space is inserted by the counter connector, the front end of the counter connector will press on the arc section 82 to move the arc section upward and urges the contacting section 83 of the first detecting pin to touch the contact section 92 of the second pin. As a result the two detecting pins complete detecting function.

However, the disclosure is illustrative only, changes may be made in detail, especially in matter of shape, size, and arrangement of parts within the principles of the invention.

What is claimed is:

1. An electrical connector comprising:

an insulating housing defining a base portion and a tongue portion extending forwards from a front face of the base portion;

a shell assembled to the housing and defining a mating port for receiving an inserting plug in an inserting direction, into which the tongue portion extends;

a plurality of contacts defining contacting portions located on one face of the tongue portion;

a pair of detecting pins comprising a moveable pin and an immoveable pin, the two pins respectively defining a contacting section mating with each other and a leg section spaced from each other;

the base portion of the insulating housing defining a first hole running through a mounting face thereof and the front face thereof and the moveable pin being retained in the first hole;

the moveable pin defining an arc section connecting with the contacting portion and the leg portion, the arc section being received in the first hole with a front tip of the arc section projecting forwards beyond the front face;

the front tip of the arc section of the moveable pin moving back into the first hole when the mating port is inserted by the inserting plug.

2. The electrical connector as claimed in claim 1, wherein base portion defines a second holes behind the first hole and running through the mounting face to receive the immoveable pin.

3. The electrical connector as claimed in claim 2, wherein the front tip of the arc section is disposed below the contacting portions of the contacts.

4. The electrical connector as claimed in claim 1, wherein the first hole is aligned with and communicating with one passageway receiving one of said contacts.

5. An electrical connector comprising:

an insulative housing defining a base portion with a tongue portion extending forwardly from a front face of the base portion;

a metallic shell assembled to the housing and defining a mating port for receiving an inserting plug, into which said tongue portion extends;

said mating port and said tongue portion dimensioned and configured to be essentially of a standard USB (Universal Serial Bus) mating interface;

a plurality of contacts disposed in the housing with corresponding deflectable contacting sections exposed into the mating port in compliance with the standard USB mating interface;

first and second switch terminals disposed in the housing both having the soldering section independently mounted to a printed circuit board, the first switch terminal defining a moveable contacting section extending into the mating port for engagement with said inserted plug, said first switch terminal and said second switch terminal being disengaged from each other when said moveable contacting section freely extends into the mating port while engaged with each other when said moveable contacting section is pressed by the inserted plug; wherein said first switch terminal is not mechanically and electrically engaged with any of said contacts disregarding whether said moveable contacting section is pressed by the inserted plug or not;

wherein the moveable contacting section of the first switch terminal is moveable back and forth along an inserting direction of the plug, and the second switch terminal is located behind the first switch terminal along said insertion direction.

6. An electrical connector comprising:

an insulative housing defining a base portion with a tongue portion extending forwardly from a front face of the base portion;

a metallic shell assembled to the housing and defining a mating port for receiving an inserting plug, into which said tongue portion extends;

said mating port and said tongue portion dimensioned and configured to be essentially of a standard USB (Universal Serial Bus) mating interface;

a plurality of contacts disposed in the housing with corresponding deflectable contacting sections exposed into the mating port in compliance with the standard USB mating interface;

first and second switch terminals disposed in the housing both having the soldering section independently mounted to a printed circuit board, the first switch terminal defining a moveable contacting section extending into the mating port for engagement with said inserted plug, said first switch terminal and said second switch terminal being disengaged from each other when said moveable contacting section freely extends into the mating port while engaged with each other when said moveable contacting section is pressed by the inserted plug; wherein said first switch terminal is not mechanically and electrically engaged with any of said contacts disregarding whether said moveable contacting section is pressed by the inserted plug or not;

wherein the contacting section of the first switch terminal is moveable back and forth along a deflection direction same with that of the contacts, and the second switch terminal is located behind the first switch terminal in said deflection direction.

* * * * *